US006495029B1

(12) United States Patent
Schorfheide et al.

(10) Patent No.: US 6,495,029 B1
(45) **Date of Patent: *Dec. 17, 2002**

(54) COUNTERCURRENT DESULFURIZATION PROCESS FOR REFRACTORY ORGANOSULFUR HETEROCYCLES

(75) Inventors: James J. Schorfheide, Baton Rouge, LA (US); Edward S. Ellis, Basking Ridge, NJ (US); Michele S. Touvelle, Baton Rouge, LA (US); Ramesh Gupta, Berkeley Heights, NJ (US)

(73) Assignee: Exxon Research and Engineering Company, Annandale, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/385,644

(22) Filed: Aug. 27, 1999

Related U.S. Application Data

(63) Continuation-in-part of application No. 08/918,638, filed on Aug. 22, 1997, now abandoned.

(51) Int. Cl.[7] ..... C10G 45/00; C10G 45/04; C10G 45/60

(52) U.S. Cl. ..... 208/213; 208/212; 208/217; 208/226; 208/211

(58) Field of Search ..... 208/211, 212, 208/213, 217, 226

(56) References Cited

U.S. PATENT DOCUMENTS

| | | | | |
|---|---|---|---|---|
| 2,952,626 A | | 9/1960 | Kelley et al. | 208/210 |
| 2,971,754 A | | 2/1961 | Seyfried | 266/5 |
| 2,987,467 A | | 6/1961 | Keith et al. | 208/97 |
| 3,017,345 A | | 1/1962 | Eastman et al. | 208/210 |
| 3,091,586 A | | 5/1963 | Pappas et al. | 208/210 |
| 3,124,526 A | | 3/1964 | Butler et al. | 208/264 |
| 3,147,210 A | | 9/1964 | Hass et al. | 208/210 |
| 3,211,641 A | | 10/1965 | Halik et al. | 208/59 |
| 3,228,871 A | | 1/1966 | Schlinger et al. | 208/58 |
| 3,268,438 A | | 8/1966 | Scott, Jr. et al. | 208/89 |
| 3,413,216 A | | 11/1968 | Doumani | 208/216 |
| 3,415,737 A | | 12/1968 | Kluksdahl | 208/159 |
| 3,425,810 A | | 2/1969 | Scott, Jr. | 23/289 |
| 3,450,784 A | | 6/1969 | Reilly et al. | 260/667 |
| 3,461,063 A | | 8/1969 | Stine et al. | 208/143 |
| 3,595,779 A | | 7/1971 | Peck et al. | 208/210 |
| 3,607,723 A | | 9/1971 | Peck et al. | 208/59 |
| 3,658,681 A | | 4/1972 | Wilson et al. | 208/211 |
| 3,671,420 A | | 6/1972 | Wilson et al. | 208/61 |
| 3,673,078 A | | 6/1972 | Kirk, Jr. | 208/89 |
| 3,714,030 A | | 1/1973 | Winsor et al. | 208/210 |
| 3,767,562 A | | 10/1973 | Sze et al. | 208/57 |
| 3,775,291 A | | 11/1973 | Sze | 208/57 |
| 3,788,976 A | | 1/1974 | Kirk, Jr. | 208/89 |
| 3,843,508 A | | 10/1974 | Wilson et al. | 208/89 |
| 3,846,278 A | | 11/1974 | Sze et al. | 208/57 |
| 3,897,329 A | | 7/1975 | Franz et al. | 208/210 |
| 3,905,893 A | | 9/1975 | Christman et al. | 208/210 |
| 4,021,330 A | | 5/1977 | Satchell, Jr. | 208/89 |
| 4,022,682 A | | 5/1977 | Bludis et al. | 208/89 |
| 4,026,674 A | | 5/1977 | McDonald | 23/283 |
| 4,194,964 A | | 3/1980 | Chen et al. | 208/108 |
| 4,212,726 A | | 7/1980 | Mayes | 208/101 |
| 4,213,847 A | | 7/1980 | Chen et al. | 208/111 |
| 4,243,519 A | | 1/1981 | Schorfheide | 208/210 |
| 4,457,834 A | | 7/1984 | Caspers et al. | 208/143 |
| 4,476,069 A | | 10/1984 | Harper et al. | 261/97 |
| 4,526,757 A | | 7/1985 | Gupta | 422/106 |
| 4,591,426 A | | 5/1986 | Krasuk et al. | 208/96 |
| 4,599,162 A | | 7/1986 | Yen | 208/59 |
| 4,624,748 A | | 11/1986 | Haunschild | 203/29 |
| 4,755,281 A | | 7/1988 | Penick | 208/108 |
| 4,801,373 A | | 1/1989 | Corman et al. | 208/210 |
| 4,952,306 A | | 8/1990 | Sawyer et al. | 208/216 |
| 5,026,459 A | | 6/1991 | Quang et al. | 202/158 |
| 5,082,551 A | | 1/1992 | Reynolds et al. | 208/100 |
| 5,183,556 A | | 2/1993 | Reilly et al. | 208/57 |
| 5,252,198 A | * | 10/1993 | Harrison et al. | 208/208 R |
| 5,262,044 A | | 11/1993 | Huizinga et al. | 208/107 |
| 5,292,428 A | | 3/1994 | Harrison et al. | 208/208 R |
| 5,348,641 A | | 9/1994 | Shih | 208/89 |
| 5,366,614 A | | 11/1994 | Russ et al. | 208/65 |
| 5,378,348 A | | 1/1995 | Davis et al. | 208/27 |
| 5,449,501 A | | 9/1995 | Luebke et al. | 422/193 |
| 5,518,607 A | * | 5/1996 | Field et al. | 208/212 |
| 5,522,198 A | | 6/1996 | Byer et al. | 52/741.3 |
| 5,522,983 A | | 6/1996 | Cash et al. | 208/59 |
| 5,670,116 A | | 9/1997 | Gupta et al. | 422/191 |
| 5,705,052 A | | 1/1998 | Gupta | 208/57 |
| 5,720,872 A | | 2/1998 | Gupta | 208/57 |
| 5,769,909 A | * | 6/1998 | Bonk et al. | 48/127.9 |
| 5,779,992 A | | 7/1998 | Higashi | 422/190 |
| 5,882,505 A | | 3/1999 | Wittenbrink et al. | 208/59 |
| 5,888,376 A | | 3/1999 | Wittenbrink et al. | 208/59 |
| 5,888,377 A | | 3/1999 | Bertram | 208/59 |
| 5,906,728 A | | 5/1999 | Iaccino et al. | 208/61 |
| 5,925,235 A | | 7/1999 | Habib | 208/111.35 |
| 5,935,420 A | * | 8/1999 | Baird et al. | 208/213 |
| 5,939,031 A | | 8/1999 | Ellis et al. | 422/191 |
| 5,942,197 A | | 8/1999 | Gupta et al. | 422/191 |
| 5,985,131 A | | 11/1999 | Gupta et al. | 208/57 |
| 6,007,787 A | | 12/1999 | Gupta et al. | 422/191 |

FOREIGN PATENT DOCUMENTS

| | | | |
|---|---|---|---|
| DE | 2935191 A1 | 4/1981 | C10G/45/00 |
| GB | 1323257 | 7/1973 | C10G/13/24 |
| RU | 2016617 | 7/1994 | B01D/1/00 |

* cited by examiner

*Primary Examiner*—Nadine Preisch
*Assistant Examiner*—Tam M. Nguyen
(74) *Attorney, Agent, or Firm*—Gerard J. Hughes

(57) ABSTRACT

A process for the hydrodesulfurization (HDS) of the multiple condensed ring heterocyclic organosulfur compounds present in petroleum and chemical streams. The stream is passed through at least one reaction zone countercurrent to the flow of a hydrogen-containing treat gas, and through at least one sorbent zone. The reaction zone contains a bed of Group VIII metal-containing hydrodesulfurization catalyst and the sorbent zone contains a bed of hydrogen sulfide sorbent material.

19 Claims, No Drawings

COUNTERCURRENT DESULFURIZATION PROCESS FOR REFRACTORY ORGANOSULFUR HETEROCYCLES

CROSS REFERENCE TO RELATED APPLICATIONS

This is a continuation-in-part of U.S. Ser. No. 08/918,638 filed Aug. 22, 1997, now abandoned.

FIELD OF THE INVENTION

The present invention relates to a process for the hydrodesulfurization (HDS) of the multiple condensed ring heterocyclic organosulfur compounds present in petroleum and chemical streams. The stream is passed through at least one reaction zone countercurrent to the flow of a hydrogen-containing treat gas, and through at least one sorbent zone. The reaction zone contains a bed of Group VIII metal-containing hydrodesulfurization catalyst and the sorbent zone contains a bed of hydrogen sulfide sorbent material.

BACKGROUND OF THE INVENTION

Hydrodesulfurization is one of the fundamental processes of the refining and chemical industries. The removal of feed sulfur by conversion to hydrogen sulfide is typically achieved by reaction with hydrogen over non-noble metal sulfides, especially those of Co/Mo and Ni/Mo, at fairly severe temperatures and pressures to meet product quality specifications, or to supply a desulfurized stream to a subsequent sulfur sensitive process. The latter is a particularly important objective because some processes are carried out over catalysts which are extremely sensitive to poisoning by sulfur. This sulfur sensitivity is sometimes sufficiently acute as to require a substantially sulfur free feed. In other cases environmental considerations and mandates drive product quality specifications to even lower sulfur levels.

There is a well established hierarchy in the ease of sulfur removal from the various organosulfur compounds common to refinery and chemical streams. Simple aliphatic, naphthenic, and aromatic mercaptans, sulfides, di- and polysulfides and the like surrender their sulfur more readily than the class of heterocyclic sulfur compounds comprised of thiophene and its higher homologs and analogs. Within the generic thiophenic class, desulfurization reactivity decreases with increasing molecular structure and complexity. While simple thiophenes represent the more labile sulfur types, the other extreme, which is sometimes referred to as "hard sulfur" or "refractory sulfur" is represented by the derivatives of dibenzothiophene, especially those mono- and di-substituted and condensed ring dibenzothiophenes bearing substituents on the carbons beta to the sulfur atom. These highly refractory sulfur heterocycles resist desulfurization as a consequence of steric inhibition precluding the requisite catalyst-substrate interaction. For this reason, these materials survive traditional desulfurization and they poison subsequent processes whose operability is dependent upon a sulfur sensitive catalyst. Destruction of these "hard sulfur" types can be accomplished under relatively severe process conditions, but this may prove to be economically undesirable owing to the onset of harmful side reactions leading to feed and/or product degradation. Also, the level of investment and operating costs required to drive the severe process conditions may be too great for the required sulfur specification.

Typically, catalytic hydrodesulfurization of liquid-phase petroleum feedstocks is carried out in co-current, downflow, "trickle bed" reactors in which both the preheated liquid feedstock and a hydrogen-containing treat gas are introduced to the reactor at a point, or points, above one or more fixed beds of hydrodesulfurization catalyst. The liquid feedstock, any vaporized hydrocarbons, and hydrogen-containing treat gas all flow in a downward direction through the catalyst bed(s). The resulting combined vapor phase and liquid phase effluents are normally separated in a series of one or more separator vessels, or drums, downstream of the reactor.

Conventional co-current catalytic hydrodesulfurization has met with a great deal of commercial success, however, it has limitations. For example, because of hydrogen consumption and treat gas dilution by light reaction products, hydrogen partial pressure decreases between the reactor inlet and outlet. At the same time, any hydrodesulfurization reactions that take place results in increased concentrations of $H_2S$ which strongly inhibits the catalytic activity and performance of most hydroprocessing catalysts through competitive adsorption onto the catalyst. Thus, the downstream portion of catalyst in a trickle bed reactor are often limited in reactivity because of the simultaneous occurrence of multiple negative effects, such as low $H_2$ partial pressure and the presence of the high concentrations of $H_2S$. Further, if a bed of is present downstream of a co-current hydrodesulfurization zone its effect is quickly diminished if substantial sulfur breakthrough occurs. Further, liquid phase concentrations of the targeted hydrocarbon reactants are also the lowest at the downstream part of the catalyst bed.

Another type of hydroprocessing is countercurrent hydroprocessing which has the potential of overcoming many of these limitations, but is presently of very limited commercial use. U.S. Pat. No. 3,147,210 discloses a two stage process for the hydrofining-hydrogenation of high-boiling aromatic hydrocarbons. The feedstock is first subjected to catalytic hydrofining, preferably in co-current flow with hydrogen, then subjected to hydrogenation over a sulfur-sensitive noble metal hydrogenation catalyst countercurrent to the flow of a hydrogen-containing treat gas. U.S. Pat. Nos. 3,767,562 and 3,775,291 disclose a countercurrent process for producing jet fuels, whereas the jet fuel is first hydrodesulfurized in a co-current mode prior to two stage countercurrent hydrogenation. U.S. Pat. No. 5,183,556 also discloses a two stage co-current/countercurrent process for hydrofining and hydrogenating aromatics in a diesel fuel stream.

In light of the above, there is still a need for a desulfurization process that can convert feeds bearing the refractory, condensed ring sulfur heterocycles at relatively mild process conditions to products containing substantially no sulfur.

SUMMARY OF THE INVENTION

In accordance with the present invention, there is provided a process for the desulfurization of a stream selected from petroleum and chemical streams containing condensed ring sulfur heterocyclic compounds in a process unit comprised of at least one reaction zone having a non-reaction zone upstream and downstream thereof and at least one sorbent zone containing a bed of hydrogen sulfide sorbent material downstream of the first of said at least one reaction zones, which reaction zone(s) contain hydrodesulfurization catalyst, which process comprises:

(a) feeding said stream to one or more hydrodesulfurization reaction zones counter-current to upflowing hydrogen-containing treat gas;

(b) passing the resulting liquid phase effluent from at least one of said reaction zones through a zone containing a bed of hydrogen sulfide sorbent material;

(c) recovering a vapor phase effluent from said reaction zone in an upstream non-reaction zone, which vapor phase effluent is comprised of hydrogen-containing treat gas and vaporized sulfur reaction products from said reaction zone:

(d) recovering downstream from said sorbent zone a liquid phase effluent characterized as having substantially no sulfur.

In a preferred embodiment of the present invention, the Group VIII metal is a noble metal selected from Pt, Pd, Ir, and mixtures thereof.

In another preferred embodiment of the present invention, the hydrogen sulfide sorbent is selected from supported and unsupported metal oxides, spinels, zeolitic based materials, and layered double hydroxides.

In yet another preferred embodiment of the present invention, the sorbent zone contains a mixed bed of hydrodesulfurization catalyst and hydrogen sulfide sorbent.

DETAILED DESCRIPTION OF THE INVENTION

It is well known that so-called "easy" sulfur compounds, such as non-thiophenic sulfur compounds, thiophenes, benzothiophenes, and non-beta dibenzothiophenes can be removed without using severe process conditions. The prior art teaches that substantially more severe conditions are needed to remove the so-called "hard" sulfur compounds, such as condensed ring sulfur heterocyclic compounds which are typically present as 3-ring sulfur compounds, such as beta and di-beta dibenzothiophenes. An example of a typical three ring "hard" sulfur compound found in petroleum streams is 4,6-diethyldibenzothiophene. While the desulfurization process of the present invention is applicable to all sulfur bearing compounds common to petroleum and chemical streams, it is particularly suitable for the desulfurization of the least reactive, most highly refractory sulfur species, particularly the class derived from dibenzothiophenes, and most especially the alkyl, aryl, and condensed ring derivatives of this heterocyclic group, particularly those bearing one or more substituents in the 3-, 4-, 6-, and 7-positions relative to the thiophenic sulfur. The process of the present invention will result in a product stream with substantially no sulfur. For purposes of this invention, the term, "substantially no sulfur", depends upon the overall process being considered, but can be defined as a value less than about 1 wppm, preferably less than about 0.5 wppm, more preferably less than about 0.1 wppm, and most preferably less than about 0.01 wppm as measured by existing, conventional analytical technology. It is important that the sulfur levels be as low as possible because the noble metal ring-opening catalysts are susceptible to deactivation, even at relatively low sulfur levels.

Catalysts suitable for use in the present invention are those comprised of a noble or non-noble metal, or metals, of Group VIII of the Periodic Table of the Elements supported in a highly dispersed and substantially uniformly distributed manner on a refractory inorganic support. Various promoter metals may also be incorporated for purposes of selectivity, activity, and stability improvement.

Group VIII noble metals that may be used for the hydrodesulfurization catalysts of the present invention include Pt, Pd, Ir, Rh, Ru, and Os; preferably Pt, Pd, and Ir; and more preferably Pt and Pd. Preferred bimetallic noble metal catalysts include Pt—Ir, Pd—Ir, and Pt—Pd; Pt—Ir and Pt—Pd. These mono- and bimetallic noble metal catalysts may contain a promoter metal, preferably selected from Re, Cu, Ag, Au, Sn, Zn, and the like, for stability and selectivity improvement. Preferred Group VIII non-noble metals are Fe, Co and Ni, more preferably Ni, and most preferably Ni promoted with Mo. In addition to these Group VIII metals, hydrogenation catalysts based on Cu and compounds of Cu known in the art may serve as the hydrodesulfurization catalyst of this invention. Copper chromite is a preferred example of this class of catalysts.

Suitable support materials for the catalysts and hydrogen sulfide sorbents of the present invention include inorganic, refractory materials such as alumina, silica, silicon carbide, amorphous and crystalline silica-aluminas, silica-magnesias, aluminophosphates boria, titania, zirconia, and mixtures and cogels thereof. Preferred supports include alumina and the crystalline silica-aluminas, particularly those materials classified as clays or zeolitic materials, and more preferably controlled acidity zeolitic materials, including aluminophosphates, and modified by their manner of synthesis, by the incorporation of acidity moderators, and post-synthesis modifications such as demetallation and silylation. For purposes of this invention particularly desirable zeolitic materials are those crystalline materials having micropores and include conventional zeolitic materials and molecular sieves, including aluminophosphates and suitable derivatives thereof. Such materials also include pillared clays and layered double hydroxides.

The noble metals may be loaded onto these supports by conventional techniques known in the art. These include impregnation by incipient wetness, by adsorption from excess impregnating medium, or by ion exchange. The metal bearing catalysts are typically dried, calcined, and reduced; the latter may either be conducted ex situ or in situ as preferred. The catalysts are not presulfided as the presence of sulfur is not essential to HDS or ASAT activity and activity maintenance. However, in some cases the sulfided form of the catalyst may be employed without harm and may be preferred if the absence of catalyst sulfur contributes to the loss of selectivity or to decreased stability. If sulfiding is desired, then it can be accomplished by exposure to dilute hydrogen sulfide in hydrogen or by exposure to a sulfur containing hydrocarbon feed until sulfur breakthrough is observed.

Total metal loading for noble metal based HDS and ASAT catalysts is in the range of about 0.01 to 5 wt. %, preferably to 0.1 to 2 wt. %, and more preferably to 0.15 to 2 wt. %. For polymetallic noble metal catalysts similar ranges are applicable to each component; however, the bimetallics may be either balanced or unbalanced where the loadings of the individual metals may either be equivalent, or the loading of one metal may be greater or less than that of its partner. The loading of stability and selectivity modifiers ranges from 0.01 to 2 wt. %, preferably 0.02 to 1.5 wt. %, and more preferably 0.03 to 1.0 wt. %. The catalysts may or may not contain chloride and sulfur. Chloride levels range from 0.3 to 2.0 wt. %, preferably 0.5 to 1.5 wt. %, and more preferably 0.6 to 1.2 wt. %. Sulfur loadings of the noble metal catalysts approximate those produced by breakthrough sulfiding of the catalyst and range from 0.01 to 1.2 wt. %, preferably 0.02 to 1.0 wt. %.

The hydrogen sulfide sorbent of this invention may be selected from several classes of material known to be reactive toward hydrogen sulfide and capable of binding same in either a reversible or irreversible manner. Metal oxides are useful in this capacity and may be employed as the bulk oxides or may be supported on an appropriate support material such as an alumina, silica, or a zeolite, or mixtures thereof. Representative metal oxides include those of the metals from Groups IA, IIA, IB, IIB, IIIA, IVA, VB, VIB, VIIB, VIII of the Periodic Table of the Elements. The Periodic Table of the Elements referred to herein is that published by Sargent-Welch Scientific Company, Catalog No. S-18806, Copyright 1980. Representative elements include Zn, Fe, Ni, Cu, Mo, Co, Mg, Mn, W, K, Na, Ca, Ba, La, V, Ta, Nb, Re, Zr, Cr, Ag, Sn, and the like. The metal oxides may be employed individually or in combination. The preferred metal oxides are those of Ba, K, Ca, Zn, Co, Ni, and Cu. Representative supported metal oxides include ZnO on alumina, CuO on silica, ZnO/CuO on kieselguhr, and the like. Compounds of the Group IA and IIA metals capable of functioning as hydrogen sulfide sorbents include, in addition to the oxides, the hydroxides, alkoxides, and sulfides. These systems are disclosed in the following patents of Baird et al. incorporated herein by reference: U.S. Pat. Nos. 4,003,823; 4,007,109; 4,087,348; 4,087,349; 4,119,528; 4,127,470.

Spinels represent another class of hydrogen sulfide sorbents useful in this invention. These materials are readily synthesized from the appropriate metal salt, frequently a sulfate, and sodium aluminate under the influence of a third agent like sulfuric acid. Spinels of the transition metals listed above may be utilized as effective, regenerable hydrogen sulfide sorbents; zinc aluminum spinel, as defined in U.S. Pat. No. 4,263,020, incorporated herein by reference, is a preferred spinel for this invention. The sulfur capacity of spinels may be promoted through the addition of one or more additional metals such as Fe or Cu as outlined in U.S. Pat. No. 4,690,806, which is incorporated herein by reference.

Zeolitic materials may serve as hydrogen sulfide sorbents for this invention as detailed in U.S. Pat. No. 4,831,206 and -207, which are incorporated herein by reference. These materials share with spinels the ability to function as regenerable hydrogen sulfide sorbents and permit operation of this invention in a mode cycling between sulfur capture and sulfur release in either continuous or batch operation depending upon the process configuration. Zeolitic materials incorporating sulfur active metals by ion exchange are also of value to this invention. Examples include Zn4A, chabazite, and faujasite moderated by the incorporation of zinc phosphate, and transition metal framework substituted zeolites similar to, but not limited to, U.S. Pat. Nos. 5,185,135/6/7, and 5,283,047, and continuations thereof, all incorporated herein by reference.

Various derivatives of hydrotalcite (often referred to as LDH, layered double hydroxides) exhibit high sulfur capacities and for this reason serve as hydrogen sulfide sorbents for this invention. Specific examples include $Mg_{4.8}Al_{1.2}(OH)_{12}Cl_{1.2}$, $Zn_4Cr_2(OH)_{12}Cl_2$, $Zn_4Al_2(OH)_{12}Cl_2$, $Mg_{4.5}Al_{1.5}(OH)_{12}Cl_{1.5}$, $Zn_4Fe_2(OH)_{12}Cl_2$, and $Mg_4Al_2(OH)_{12}Cl_3$ and may include numerous modified and unmodified synthetic and mineral analogs of these as described in U.S. Pat. Nos. 3,539,306, 3,796,792, 3,879,523, and 4,454,244, and reviewed by Cavani et al. in *Catalysis Today,* Vol. 11, No. 2, pp. 173–301 (1991), all of which are incorporated herein by reference. Particularly active hydrogen sulfide sorbents are LaRoach H-T, $ZnSi_2O_5$ gel, $Zn_4Fe_2(OH)_{12}Cl_2$, and the Fe containing clay, nontronite. A study of several Mg—Al hydrotalcites demonstrated a preference for crystallites less than about 300 Angstroms. Particularly novel are pillared varieties of smectites, kandites, LDHs and silicic acids in which the layered structure is pillared by oxides of Fe, Cr, Ni, Co, and Zn, or such oxides in combination with alumina as demonstrated by, but not limited to, U.S. Pat. Nos. 4,666,877, 5,326,734, 4,665,044/5 and Brindley et al, *Clays And Clay Minerals,* 26, 21 (1978) and *Amer. Mineral,* 64, 830 (1979), all incorporated herein by reference. The high molecular dispersions of the reactive metal make them very effective scavengers for sulfur bearing molecules.

A preferred class of hydrogen sulfide sorbents are those which are regenerable as contrasted to those which bind sulfur irreversibly in a stoichiometric reaction. Hydrogen sulfide sorbents which bind sulfur through physical adsorption are generally regenerable through manipulation of the process temperature, pressure, and/or gas rate so that the sorbent may cycle between adsorption and desorption stages. Representative of such sorbents are zeolitic materials, spinels, meso-. and microporous transition metal oxides, particularly oxides of the fourth period of the Periodic Chart of the Elements.

Hydrogen sulfide sorbents which bind sulfur through a chemisorptive mechanism may also be regenerated by the use of reactive agents through which the sulfur bearing compound is reacted and restored to its initial, active state. Reagents useful for the regeneration of these types of hydrogen sulfide sorbents are air (oxygen), steam, hydrogen, and reducing agents such as carbon and carbon monoxide. The choice of regenerating agent is determined by the initial, active state of the sorbent and by the chemical intermediates arising during the regeneration procedure. Active hydrogen sulfide sorbents regenerable by reaction with oxygen include the oxides of manganese, lanthanum, vanadium, tantalum, niobium, molybdenum, rhenium, zirconium, chromium, and mixtures thereof. Active hydrogen sulfide sorbents regenerable through reaction with steam, either alone or in combination with oxygen, include the oxides of lanthanum, iron, tin, zirconium, titanium, chromium, and mixtures thereof. Active hydrogen sulfide sorbents regenerable through the sequential action of hydrogen and oxygen include the oxides of iron, cobalt, nickel, copper, silver, tin, rhenium, molybdenum, and mixtures thereof. Active hydrogen sulfide sorbents regenerable through the action of hydrogen include iron, cobalt, nickel, copper, silver, mercury, tin, and mixtures thereof. In addition all transition metal oxides are regenerable from their corresponding sulfates by reduction with hydrogen, carbon, or carbon monoxide. These regeneration reactions may be facilitated by the inclusion of a catalytic agent that facilitates the oxidation or reduction reaction required to restore the sulfur sorbent to its initial, active condition.

In addition, of particular interest as regenerable hydrogen sulfide sorbents are two classes of materials: zeolitic materials enriched in the alkali metals of Group IA; the high surface area, porous materials represented by zeolite-like structures, nonstoichiometric basic oxides of the transition metals, reviewed in part by Wadsley (Nonstoichiometric Compounds, edited by Mandelkorn, Academic Press, 1964) and numerous surfactant templated metal oxide materials analogous to MCM-41 type structures as disclosed in U.S. Pat. No. 5,057,296 incorporated herein by reference.

These regeneration processes operate over a temperature range of 100–700° C., preferably 150–600° C., and more preferably 200–500° C. at pressures comparable to those cited below in the general disclosure of process conditions common to this invention.

Also suitable are activated carbons and acidic activated carbons that have undergone treatment well known to those having skill in the art to enhance their acidic properties. Acidic salts may also be added to the activated carbons, used on other high surface area supports, or used as bulk sorbents.

The hydrodesulfurization catalyst and the hydrogen sulfide sorbent used in the practice of the present invention may be utilized in various bed configurations within the reactor. The choice of configuration may or may not be critical depending upon the objectives of the overall process, particularly when the process of the present invention is integrated with one or more subsequent processes, or when the objective of the overall process is to favor the selectivity of one aspect of product quality relative to another. Various bed configurations are disclosed with the understanding that the selection of a specific configuration is tied to these other process objectives. A bed configuration utilizing a common reactor where the hydrogen sulfide sorbent zone is placed upstream of the hydro-desulfurization catalyst zone is excluded. One bed configuration consists of a stacked bed wherein the hydrodesulfurization catalyst is stacked, or layered, above and upstream of the hydrogen sulfide sorbent zone. Stacked beds may either occupy a common reactor, or the hydrodesulfurization catalyst may occupy a separate reactor upstream of the reactor containing the hydrogen sulfide sorbent. This dedicated reactor sequence is preferred when it is desirable to operate the hydrodesulfurization catalyst and the hydrogen sulfide sorbent at substantially different reactor temperatures or to facilitate frequent or continuous replacement of the hydrogen sulfide sorbent material.

The hydrogen sulfide sorbent zone can also contain a mixed bed wherein particles of the hydrodesulfurization catalyst are intimately intermixed with those of the hydrogen sulfide sorbent. In both the stacked and mixed bed configurations, the two components may share similar or identical shapes and sizes, or the particles of one may differ in shape and/or size from the particles of the second component. The latter relationship is of potential value to the mixed bed configuration if it should be desirable to effect a simple physical separation of the bed components upon discharge or reworking.

Materials can also be formulated which allow the HDS function and the hydrogen sulfide sorbent function to reside on a common particle. In one such formulation, the HDS and hydrogen sulfide sorbent components are blended together to form a composite particle. For example, a finely divided, powdered Pt on alumina catalyst is uniformly blended with zinc oxide powder and the mixture formed into a common catalyst particle, or zinc oxide powder is incorporated into the alumina mull mix prior to extrusion, and Pt is impregnated onto the zinc oxide-containing alumina in a manner similar to that described in U.S. Pat. No. 4,963,249, which is incorporated herein by reference.

Another formulation is based on the impregnation of a support with a HDS-active metal salt (e.g., Pt) and a hydrogen sulfide sorbent-active salt (e.g., Zn) to prepare a bimetallic catalyst incorporating the HDS metal and the hydrogen sulfide sorbent on a common base. For example, a Pt—Zn bimetallic may be prepared in such a manner as to distribute both metals uniformly throughout the extrudate, or, alternatively, the Zn component may be deposited preferentially in the exterior region of the extrudate to produce a rim, or eggshell, Zn rich zone, or the Pt component may be deposited preferentially in the exterior region of the extrudate to produce a rim, or eggshell, Pt rich zone. These are often referred to as "cherry" structures.

Three component bed configurations are also suitable for use herein, the choice of which is subject to the conditions previously disclosed for two component systems. One variation of the three component bed is the stacked/stacked/stacked configuration where the three components are layered sequentially with a hydrodesulfurization catalyst occupying the top and bottom positions and the hydrogen sulfide sorbent the middle zone. While the three-component systems may occupy a common reactor, these systems may also occupy multiple reactors where, for example, a HDS catalyst occupies the lead reactor and a stacked hydrogen sulfide sorbent/HDS catalyst occupies the tail reactor. These arrangements permit operating the two reactor sections at different process conditions, especially temperature, and imparts flexibility in controlling process selectivity and/or product quality.

It will also be understood that the present invention can be practiced such that the hydrogen sulfide sorbent zone contains a mixed bed of hydrodesulfurization catalyst and hydrogen sulfide sorbent, a composite of hydrodesulfurization catalyst and hydrogen sulfide sorbent, and/or a support impregnated with a hydrogen sulfide sorbent active salt, and a hydrodesulfurization active metal.

The composition of the sorbent bed is independent of configuration and may be varied with respect to the specific process, or integrated process, to which this invention is applied. In those instances where the capacity of the hydrogen sulfide sorbent is limiting, the composition of the sorbent bed must be consistent with the expected lifetime, or cycle, of the process. These parameters are in turn sensitive to the sulfur content of the feed being processed and to the degree of desulfurization desired. For these reasons, the composition of the guard bed is flexible and variable, and the optimal bed composition for one application may not serve an alternative application equally well. In general, the weight ratio of the hydrogen sulfide sorbent to the hydrodesulfurization catalyst may range from 0.01 to 1000, preferably from 0.5 to 40, and more preferably from 0.7 to 30.

The feedstocks of the present invention are subjected to countercurrent hydrodesulfurization in at least one catalyst bed, or reaction zone, wherein feedstock flows countercurrent to the flow of a hydrogen-containing treat gas. It is within the scope of the present invention that the feed steam first pass through a co-current hydrotreating reaction zone which contains a hydrotreating catalyst, preferably a hydrodesulfurization catalyst, preferably a non-noble metal catalyst. The liquid effluent will then be passed to at least one countercurrent reaction zone containing hydrodesulfurization catalyst, preferably a noble metal catalyst. Each reaction zone will be preceded and followed by a non-reaction zone where products can be removed and/or feed or treat gas introduced. The non-reaction zone will be a zone which does not contain catalyst. The non-reaction zone can be an empty cross-section in the reaction vessel or it can contain a material suitable for promoting liquid/gas contacting. Non-limiting examples of such materials that can be used to promote liquid/gas contacting include glass beads, wire mesh, as well as other suitable inert material that can withstand the process conditions in the non-reaction zone. Upflowing hydrogen-containing treat gas flowing through the non-reaction zone will serve to strip dissolved sulfur reaction products such as $H_2S$ from the liquid effluent flowing through the zone.

Suitable hydrodesulfurization catalysts for use in an upstream co-current reaction zone, if present, can be any conventional hydrotreating catalyst and includes those which are comprised of at least one Group VIII metal, preferably Fe, Co and Ni, more preferably Co and/or Ni, and most preferably Ni; and at least one Group VI metal, preferably Mo and W, more preferably Mo, on a high surface area support material, preferably alumina. The Group VIII metal is typically present in an amount ranging from about 2 to 20 wt. %, preferably from about 4 to 12%. The Group VI metal will typically be present in an amount ranging from about 5 to 50 wt. %, preferably from about 10 to 40 wt. %, and more preferably from about 20 to 30 wt. %. All metals weight percents are on support. By "on support" we mean that the percents are based on the weight of the support. For example, if the support were to weigh 100 g. then 20 wt. % Group VIII metal would mean that 20 g. of Group VIII metal was on the support. Typical hydrodesulfurization temperatures will range from about 100° C. to about 400° C. at pressures from about 50 psig to about 2,000 psig.

While the present process need not have a co-current reaction zone, it will have at least one countercurrent reaction zone wherein the liquid feedstream will flow downward counter to upflowing hydrogen-containing treat gas. It will be understood that the treat gas need not be pure hydrogen, but can be any suitable hydrogen-containing treat gas. The vapor phase which in the catalyst bed of a countercurrent reaction zone, will typically contain sulfur impurities, will be swept upward with the upflowing hydrogen-containing treat-gas and collected, fractionated, or passed along for further processing. It is to be understood that all reaction zones can either be in the same vessel separated by non-reaction zones, or any can be in separate vessels. The non-reaction zones in the latter case will include the transfer lines leading from one vessel to another. If a preprocessing step is performed to remove the so-called "easy sulfur", the vapor and liquid are disengaged and the liquid effluent directed to the countercurrent reactor or reaction zone. The vapor from the preprocessing step can be processed separately or combined with the vapor phase product from the countercurrent reactor. The vapor phase product(s) may undergo further vapor phase hydroprocessing if greater reduction in heteroatom and aromatic species is desired or sent directly to a recovery system. The catalyst may be contained in one or more beds in one vessel or multiple vessels. Various hardware (i.e. distributors, baffles, heat transfer devices) may be required inside the vessel(s) to provide proper temperature control and contacting (hydraulic regime) between the liquid, vapors, and catalyst.

The countercurrent contacting of an effluent stream from a reaction zone, with hydrogen-containing treat gas, strips dissolved $H_2S$ impurities from the effluent stream, thereby improving catalyst performance. That is, the catalyst and sorbent can be on-stream for substantially longer periods of time before regeneration or replacement is required. Further, higher sulfur removal levels will be achieved by the process of the present invention.

The hydrogen sulfide sorbent zone can be placed in any location or locations downstream from the first reaction zone. Further, the sorbent can be either contiguous and downstream from a reaction zone, or it can be separated by a non-reaction zone. It is preferred that the sorbent zone be separated from an upstream reaction zone by a non-reaction zone, more preferably when the non-reaction zone contains a substantially inert material that will promote liquid/gas contacting. The hydrogen sulfide sorbent zone can be operated in either a countercurrent or co-current mode.

The process of this invention is operable over a range of conditions consistent with the intended objectives in terms of product quality improvement and consistent with any downstream process with which this invention is combined in either a common or sequential reactor assembly. It is understood that hydrogen is an essential component of the process and may be supplied pure or admixed with other passive or inert gases as is frequently the case in a refining or chemical processing environment. It is preferred that the hydrogen stream be sulfur free, or substantially sulfur free, and it is understood that the latter condition may be achieved if desired by conventional technologies currently utilized for this purpose. In general, the conditions of temperature and pressure are significantly mild relative to conventional hydroprocessing technology, especially with regard to the processing of streams containing the refractory sulfur types as herein previously defined. This invention is commonly operated at conditions that favor aromatic hydrogenation as opposed to conditions that favor reforming. These conditions include temperatures of 40–425° C. (104–932° F.) and preferably 225–400° C. (437–752° F.). Operating pressure includes 100–3000 psig, preferably 100–2,200 psig, and more preferably 100–1,000 psig at gas rates of 50–10,000 SCF/B (standard cubic feet per barrel), preferably 100–7, 500 SCF/B, and more preferably 500–5,000 SCF/B. The feed rate may be varied over the range 0.1–100 LHSV (liquid hourly space velocity), preferably 0.3–40 LHSV, and more preferably 0.5–30 LHSV.

The process of this invention may be utilized as a stand-alone process for purposes of various fuels, lubes, and chemicals applications. Alternatively, the process may be combined and integrated with other processes in a manner so that the net process affords product and process advantages and improvements relative to the individual processes not combined. Potential opportunities for the application of the process of this invention follow; these illustrations are not intended to be limiting.

Process applications relating to fuels processes include: desulfurization of FCC streams preceding recycle to 2nd stage processing; desulfurization of hydrocracking feeds; multiring aromatic conversion through selective ring opening (U.S. Pat. Nos. 5,763,731; 5,811,624 and U.S. Ser. Nos. 523,300; 524,357, filed Sep. 5, 1995 and incorporated herein by reference); aromatics saturation processes; sulfur removal from natural gas and condensate streams. Process applications relating to the manufacture of lubricants include: product quality improvement through mild finishing treatment; optimization of white oil processes by decreasing catalyst investment and/or extending service factor; pretreatment of feed to hydroisomerization, hydrodewaxing, and hydrocracking. Process applications relating to chemicals processes include: substitute for environmentally unfriendly nickel based hydroprocessing; preparation of high quality feedstocks for olefin manufacture through various cracking processes and for the production of oxygenates by oxyfunctionalization processes.

This invention is illustrated by, but not limited to, the following examples. The efficacy of the process of this invention is assessed through the use of a highly sulfur sensitive reaction, the opening of naphthenic rings by Ir containing catalysts.

EXAMPLE 1

A 0.9 wt. % Ir catalyst was prepared by impregnating alumina with a standardized solution of chloroiridic acid. The catalyst was dried, mildly calcined in air, and reduced in hydrogen. The catalyst was evaluated as a ring opening catalyst to convert methylcyclohexane to the acyclic $C_7$ isomers, n-heptane, and 2-, and 3-methylhexanes. The course of the ring opening reaction as a function of time was followed using methylcyclohexane conversion and the total rate of formation of the isomeric heptanes as measures. The results of this model reaction appear in Table 1.

EXAMPLE 2

The Ir catalyst of Example 1 was evaluated for ring opening of methylcyclohexane to which 5 wppm sulfur had been added as thiophene. The results of this experiment appear in Table 1. Comparison of Example 1 with Example 2 reveals an acute sensitivity to sulfur poisoning by the Ir catalyst as all ring opening activity is essentially lost within 20 hr on oil.

EXAMPLE 3

A stacked catalyst bed consisting of 3 g of zinc oxide on top of 2 g of the Ir catalyst of Example 1, the two zones separated by a bed of mullite beads, was evaluated for the ring opening of methylcyclohexane containing 5 wppm sulfur as thiophene. The Ir catalyst charge was equivalent to those of Examples 1 and 2. The feed flow to the reactor was downstream so that the sulfur containing feed contacted the zinc oxide initially. The results of this experiment appear in Table 1. Deactivation of the Ir catalyst was similar to that of Example 2 indicating that zinc oxide by itself has no influence on the sulfur poisoning of the downstream Ir ring opening catalyst.

EXAMPLE 4

The procedure of Example 3 was repeated except that the zinc oxide particles and the Ir catalyst particles were combined to form an intimate mixture. This mixed bed was evaluated for ring opening activity on methylcyclohexane containing 5 wppm sulfur as thiophene. The results appear in Table 1. This mixed bed in which the Ir catalyst functioned as a hydrodesulfurization and a ring opening catalyst in the presence of a hydrogen sulfide sorbent illustrates the protection of a highly sulfur sensitive ring opening catalyst by the process of this invention. The activity of this catalyst was maintained for 100 hr on oil when the test was arbitrarily terminated.

EXAMPLE 5

A mixed sulfur guard bed was prepared in which 1 g of a catalyst comprised of 0.6 wt. % Pt on alumina was admixed with 2 g of zinc oxide. Downstream of this guard bed was placed 2 g of the Ir ring opening catalyst of Example 1; the overall configuration is the mixed/stacked type with the two zones separated by mullite beads. This catalyst array was evaluated for ring opening of methcyclohexane containing 5 wppm sulfur as thiophene, and the results appear in Table 1. The data show that the mixed guard bed upstream of the Ir ring opening catalyst effectively protected the latter from sulfur poisoning.

TABLE 1

Ring Opening Of Methylcyclohexane In The Presence Of Sulfur 275° C., 400 psig, 7.7 W/H/W, $H_2$/Oil = 5

| Example | Sulfur, wppm | Catalyst | Conversion, Wt. % @ Hr On Oil | | | Ring Opening Rate @ Hr On Oil | | |
|---|---|---|---|---|---|---|---|---|
| | | | 10 | 20 | 40 | 10 | 20 | 40 |
| 1 | 0 | Ir | 20.1 | 19.2 | 19.3 | 14.1 | 13.5 | 13.3 |
| 2 | 5 | Ir | 14.0 | 1.4 | 0.0 | 9.7 | 0.8 | 0.0 |
| 3 | 5 | ZnO/Ir | 21.7 | 6.3 | 0.0 | 15.1 | 4.4 | 0.0 |
| 4 | 5 | ZnO + Ir | 19.7 | 17.0 | 18.8 | 13.8 | 12.0 | 13.1 |
| 5 | 5 | 0.9 Pt + Zn O/Ir | 20.7 | 18.0 | 19.0 | 14.3 | 12.5 | 13.1 |

EXAMPLE 6

A mixed sulfur guard bed was prepared by blending 1 g of a catalyst comprised of 0.6 wt. % Pt on alumina with 2 g of zinc oxide. This mixture was layered above a 2 g bed of the Ir ring opening catalyst of Example 1 to provide a mixed/stacked configuration. This system was evaluated for the ring opening of methylcyclohexane containing 5 wppm sulfur as thiophene and 10 wppm sulfur as 4,6-diethyldibenzothiophene. The results of this experiment appear in Table 2. The results demonstrate that the mixed guard bed upstream of the ring opening catalyst protected the latter from deactivation by sulfur poisoning. Comparison of Examples 5 and 6 shows that the system is capable of desulfurizing a feed rich in a refractory sulfur compound under mild hydrodesulfurization conditions.

EXAMPLE 7

The procedure of Example 6 was followed except that the metal content of the Pt catalyst admixed with zinc oxide was decreased to 0.05 wt. %. This variation was evaluated for the ring opening of the 15 wppm sulfur methylcyclohexane feed of Example 6, and the results in Table 2 demonstrate the insensitivity of the process of this invention to metal loading while retaining the ability to hydrodesulfurize a refractory sulfur compound at mild conditions.

EXAMPLE 8

The procedure of Example 6 was repeated except that the Pt catalyst admixed with the zinc oxide was a catalyst comprised of 0.3 wt. % Pt on alumina that had been reduced and sulfided. This system was tested for ring opening activity on the 15 wppm sulfur feed of Example 6. The results in Table 2 illustrate that the process of this invention may be operated on a sulfided catalyst if desired without harm. The data also reinforce the insensitivity of the process to metal loading in the guard bed and the ability to process a refractory sulfur compound at mild conditions independent of the state of sulfidation of the hydrodesulfurization catalyst.

TABLE 2

Ring Opening Of Methylcyclohexane Containing 5 wppm Sulfur As Thiophene And 10 wppm Sulfur As 4,6-Diethyldibenzothiophene 275° C., 400 psig, 7.7 W/H/W, $H_2$/Oil = 6

| Example | Catalyst | Conversion, Wt. % @ Hr On Oil | | | Ring Opening Rate @ Hr On Oil | | |
|---|---|---|---|---|---|---|---|
| | | 10 | 20 | 100 | 10 | 20 | 100 |
| 6 | 0.6 Pt + ZnO/Ir | 14.8 | 14.3 | 13.0 | 10.4 | 10.0 | 9.1 |
| 7 | 0.05 Pt + ZnO/Ir | 27.1 | 24.2 | 20.9 | 18.6 | 16.8 | 14.5 |
| 8 | 0.3 PtS + ZnO/Ir | 15.0 | 13.6 | 12.1 | 10.6 | 9.5 | 8.3 |

EXAMPLE 9

The procedure of Example 6 was followed to prepare a mixed/stacked catalyst bed comprising 0.6 wt. % Pt on alumina commingled with zinc oxide upstream of the Ir ring opening catalyst. This system was evaluated for the ring opening of methylcyclohexane containing 50 wppm sulfur as 4,6-diethyldibenzothiophene. The results in Table 3 establish the retention of stable ring opening activity for an extended period of operation on this sulfur rich feed and on this highly refractory sulfur compound, which is being hydrodesulfurized over a noble metal catalyst at mild conditions.

EXAMPLE 10

The procedure of Example 9 was followed except that the Pt catalyst and the zinc oxide were not commingled but were arranged so that the Pt layer was above that of zinc oxide and separated by mullite beads, and that the complete catalyst bed was of the stacked/stacked/stacked variety. As Table 3 illustrates, this system was equally effective for sustaining ring opening activity on the methylcyclohexane feed containing 50 wppm sulfur as 4,6-diethyldibenzothiophene.

EXAMPLE 11

The procedure of Example 9 was followed except that a 1 wt. % Pd catalyst on alumina, prepared by the impregnation of alumina with a standardized palladium chloride solution, replaced the 0.6 wt. % Pt catalyst in the mixed bed preceding the Ir ring opening catalyst. The data of Table 3 confirm the utility of the Pd catalyst for the process of this invention.

EXAMPLE 12

The procedure of Example 10 was followed except that the Pd catalyst was substituted for the Pt catalyst in the stacked guard bed configuration. The data of Table 3 show that the Pd catalyst in the stacked bed configuration is deactivated over time by sulfur in contrast to Examples 11 and 12. The results illustrate the non-equivalency of Group VIII metals and the dependency of activity maintenance on bed configuration.

TABLE 3

Ring Opening Of Methylcyclohexane Containing 50 wppm Sulfur As 4,6-Diethyldibenzothiophene 275° C., 400 psig, 7.7 W/H/W, $H_2$/Oil = 6

| | | Conversion, Wt. % @ Hr On Oil | | | Ring Opening Rate @ Hr On Oil | | |
|---|---|---|---|---|---|---|---|
| Example | Catalyst | 50 | 100 | 250 | 50 | 100 | 250 |
| 9 | Pt + ZnO/Ir | 16.9 | 15.6 | 15.3 | 11.8 | 11.0 | 10.8 |
| 10 | Pt/ZnO/Ir | 18.5 | 18.2 | 14.7 | 13.1 | 12.7 | 10.3 |
| 11 | Pd + ZnO/Ir | 21.6 | 20.9 | 19.3 | 15.2 | 14.8 | 13.5 |
| 12 | Pd/ZnO/Ir | 31.3 | 26.1 | 7.5 | 21.6 | 18.1 | 3.0 |

EXAMPLE 13

A bimetallic 0.3 wt. % Pt-0.3 wt. % Zn catalyst was prepared by impregnating alumina with standardized solutions of chloroplatinic acid and zinc nitrate. The catalyst was dried, calcined, and reduced. The procedure of Example 9 was followed except the bimetallic Pt—Zn catalyst replaced the 0.6 wt. % Pt catalyst in the mixed bed preceding the Ir catalyst. The results are shown in Table 4 below. The data show that the activity of the Pt hydrodesulfurization catalyst was not sensitive to the presence of Zn even though both metals were uniformly distributed throughout the catalyst.

EXAMPLE 14

A composite catalyst was prepared by commingling and blending a powdered 0.6 wt. % Pt on alumina catalyst with a powdered zinc oxide in a weight ratio of 1:2.2. The composite blend was formed into catalyst particles, and the catalyst was staged upstream of an Ir catalyst and tested as described in Example 9. The results presented in Table 4 demonstrate that the composite Pt—ZnO composite catalyst is equivalent to the physical blends of Pt with ZnO for the desulfurization of a refractory sulfur type.

TABLE 4

Ring Opening Of Methylcyclohexane Containing 50 wppm Sulfur As 4,6-Diethyldibenzothiophene 275° C., 400 psig, 7.7 W/H/W, $H_2$/Oil = 6

| | | Conversion, Wt. % @ Hr On Oil | | | Ring Opening Rate @ Hr On Oil | | |
|---|---|---|---|---|---|---|---|
| Example | Catalyst | 50 | 100 | 120 | 50 | 100 | 120 |
| 13 | Pt – Zn + ZnO/Ir | 21.4 | 20.6 | | 14.7 | 14.4 | |
| 14 | Pt – ZnO/Ir | 19.6 | 18.3 | 17.6 | 13.9 | 12.8 | 12.4 |
| 15 | Pt + $ZnAl_2O_4$/Ir | 10.5 | 9.6 | 8.8 | 7.3 | 6.7 | 6.1 |

EXAMPLE 15

The procedure of Example 9 was followed where a 0.6 wt. % Pt on alumina catalyst was admixed with a hydrogen sulfide sorbent comprising zinc aluminum spinel. The results shown in Table 5 indicate the preservation of ring opening activity with this mixed system.

EXAMPLE 16

The sulfide exchange capacities of four similar hydrotalcites having Mg/Al ratios of about 3 were compared in a surrogate test for hydrogen sulfide scavenging efficiency. Sodium sulfide (0.2 g) was dissolved in 10 ml of water, and 1 g of the hydrotalcite was added. The slurry was stirred at room temperature for 1 hr, and the hydrotalcite was separated by filtration. The filter cake was rinsed with 20 ml of water, which was combined with the filtrate. To the filtrate was added 0.75 g of zinc nitrate in 10 ml of water. The zinc sulfide precipitate was recovered by centrifugation, dried at 120° C. and weighed to determine by difference the sulfide exchanged into the hydrotalcite. Sulfur uptake as a function of crystallite size determined by the (001) peak width at half height is shown below. The smallest hydrotalcite crystals have 20% greater sulfur capacity demonstrating the need to minimize crystallite size, particularly important in the transition metal substituted form of these materials.

| Hydrotalcite Sample | Sulfur Adsorbed, % | (001) Peak Width |
|---|---|---|
| A | 79 | 1.49° |
| B | 79 | 0.74° |
| C | 80 | 0.85° |
| D | 94 | 2.45° |

EXAMPLE 17

The procedure of Example 6 was followed to prepare a mixed/stacked catalyst bed comprising 0.6 wt. % Pt on alumina and a mixed metal oxide, Zr—Zn—Mn blended in about a 48-28-24 composition by weight, upstream of the Ir ring opening catalyst. This system was evaluated for the ring opening of methylcyclohexane containing 50 wppm sulfur as 4,6-diethyldibenzothiophene. The results in Table 5 establish the retention of stable ring opening activity for an extended period of operation. The test was arbitrarily terminated, and the guard bed was calcined in air at 450° C. for 16 hr, and subsequently reinstalled upstream of the Ir ring opening catalyst. Second cycle activity identical to that in Table 5 was sustained for an extended period.

TABLE 5

Ring Opening Of Methylcyclohexane Containing 50 wppm Sulfur As 4,6-Diethyldibenzothiophene 275° C., 400 psig, 7.7 W/H/W, $H_2$/Oil = 6

| | | Conversion, Wt. % @ Hr On Oil | | | Ring Opening Rate @ Hr On Oil | | |
|---|---|---|---|---|---|---|---|
| Example | Catalyst | 50 | 100 | 260 | 50 | 100 | 260 |
| 17 | Pt + Zr – Zn – Mn/Ir | 27.1 | 24.7 | 22.2 | 18.5 | 17.0 | 15.1 |

Preparation of Saturated Cyclic Feedstock A

An aromatics solvent stream containing primarily $C_{11}$ and $C_{12}$ naphthalenes with an API gravity of 10.0 was hydrogenated over 180 g (250 cc) of a 0.6 wt. % Pt on alumina catalyst. The catalyst was prereduced in flowing hydrogen at 750° F. for 16 hours at atmospheric pressure. The aromatics solvent feedstock was passed over the catalyst at 1800 psig, 550° F., an LHSV of 1 with a hydrogen treat gas rate of 7000 SCF/B. The saturated product had an API gravity of 31.6 and was analyzed to contain less than 0.1 wt. % aromatics and greater than 99 wt. % naphthenes.

EXAMPLE 18

A reactor was charged with the 0.9 wt. % Ir catalyst of Example 1. The saturated cyclic feedstock A described above was spiked to 5 wppm sulfur with 4,6-diethyldibenzothiophene and processed over the catalyst. The course of the ring opening of the saturated naphthenes present in the feed was monitored by measuring the API gravity of the product. Successful conversion of naphthenes to paraffins is accompanied by an increase in gravity, and the stability of the catalyst is reflected in changes in gravity with time on oil. The results of this experiment are found in Table 6. While the Ir catalyst was highly active initially, substantial deactivation due to sulfur poisoning occurred with the catalyst being essentially deactivated around 100 hr on oil.

EXAMPLE 19

A reactor was charged with the Ir ring opening catalyst of Example 1. A sulfur guard bed comprising a catalyst comprised of 0.6 wt. % Pt on alumina and zinc oxide was placed upstream of the Ir catalyst; the three components were layered in the order Pt/ZnO/Ir in a stacked/stacked/stacked bed configuration. The weight ratios of the catalyst bed were 0.8:2.0:4.0. The same feed as in Example 18 was processed over this catalyst system, and product gravity was measured to assess the activity of the Ir catalyst. The results are presented in Table 6. Catalyst activity was effectively maintained on the 5 wppm sulfur feed for about 170 hr on oil. At that point the 4,6-diethyldibenzothiophene content of the feed was increased to give 50 wppm sulfur. As Table 6 indicates, catalyst activity was maintained for about 310 hr, including about 140 hr on the high sulfur feed, at which point the run was arbitrarily terminated. Comparison of Examples 21 and 22 confirms the process of this invention on complex streams and the ability of this process to hydrodesulfurize a highly refractory sulfur compound at mild conditions over a noble metal catalyst.

TABLE 6

Ring Opening Of Saturated Cyclic Feedstock A Containing 5–50 wppm Sulfur as 4,6-Diethyldibenzothiophene 325° C., 650 psig, 3000 SCF/B, 0.5 LHSV

| | | API Gravity @ 5 wppm S @ , Hr On Oil | | | API Gravity @ 50 wppm S @ Hr On Oil | | |
|---|---|---|---|---|---|---|---|
| Example | Catalyst | 1 | 56 | 96 | 169 | 289 | 313 |
| 18 | Ir | 35.1 | 34.2 | 32.5 | — | — | — |
| 19 | 0.6 Pt/ZnO/Ir | 35.2 | 35.1 | 34.9 | 34.9 | 34.6 | 34.8 |

EXAMPLE 20

A reactor was charged with a mixed bed of 2.9 g of a 0.6 wt. % Pt on alumina catalyst and 1.7 g of zinc oxide. The mixed catalyst system was used to process a hydrotreated light cat cycle oil with API gravity of 26 containing 5 wppm sulfur and 55 wt. % aromatics. Successful conversion of aromatics to naphthenes is accompanied by an increase in gravity, and the stability of the catalyst is reflected in changes in gravity with time on oil. Product gravity was measured to follow catalyst stability for the integrated hydrodesulfurization and aromatics saturation reactions with time on oil. The results are presented in Table 7 where a high level of activity was sustained for about 140 hr on oil.

EXAMPLE 21

A reactor was charged with a mixed bed of 2.9 g of a 0.6 wt. % Pt on alumina catalyst and 1.7 g of zinc oxide. This bed was placed upstream of the 0.9 wt. % Ir catalyst of Example 1. The mixed/stacked catalyst system was used to process the feed of Example 20. The product gravity and aromatics content were measured to follow catalyst stability for the integrated hydrodesulfurization, aromatics saturation, and ring opening reactions with time on oil. Successful conversion of aromatics to naphthenes, and naphthenes to paraffins is accompanied by an increase in gravity over that observed in Example 20. The results are presented in Table 7 where a high level of activity was sustained for about 140 hr on oil.

EXAMPLE 22

The procedure of Example 21 was followed except the Ir catalyst was admixed with 0.5 g of a 0.9 wt. % Pt on a zeolite with a high silica to alumina ratio co-catalyst; the function of the latter being to promote ring opening activity as defined in the series of patent applications incorporated by reference in the disclosure. The catalyst system was used to process the feed of Example 20. The product gravities listed in Table 7 illustrate sound catalyst performance based on the process of this invention.

EXAMPLE 23

The procedure of Example 18 was followed except that no zinc oxide was admixed with the Pt catalyst. This configuration provides a HDS/ASAT catalyst but no hydrogen sulfide sorbent. The catalyst system was used to process the feed of Example 20. The product gravities and aromatics level listed in Table 7 illustrate retention of aromatics saturation activity but significantly reduced ring opening activity compared to that of Example 21 on the 5 wppm sulfur feed.

TABLE 7

Processing Of Light Cat Cycle Oil Containing 5 wppm Sulfur and 55 Wt. % Aromatics 315° C., 650 psig, 5000 SCF/B $H_2$, 0.75 LHSV (over Pt catalyst)

| | | API Gravity @ Hr On Oil | | Wt. % Aromatics @ Hr On Oil |
|---|---|---|---|---|
| Example | Catalyst | 45 | 136 | 136 |
| 20 | Pt + ZnO | 32.8 | 32.9 | 3.3 |
| 21 | Pt + ZnO/Ir | 33.8 | 33.7 | 1.9 |
| 22 | Pt + ZnO/Ir + Pt on acid | 35.6 | 35.5 | 0.4 |
| 23 | Pt/Ir | 33.3 | 33.2 | 2.0 |

EXAMPLE 24

The catalyst system of Example 21 was used to process a second hydrotreated light cat cycle oil with API gravity of 27 containing 60 wppm sulfur and 56 wt. % aromatics. Product gravity was measured to follow catalyst stability for the integrated hydrodesulfurization and aromatics saturation reactions with time on oil. Table 8 shows no loss in catalyst performance when operated on the second, higher sulfur feed.

EXAMPLE 25

The catalyst system of Example 21 was used to process the feed of Example 24. Product gravity was measured to follow catalyst stability for the integrated hydrodesulfurization, aromatics saturation and ring opening reactions with time on oil. Table 8 shows no loss in catalyst performance when operated on the second, higher sulfur feed.

EXAMPLE 26

The catalyst system of Example 22 was used to process the feed of Example 24. Product gravity was measured to follow catalyst stability for the integrated hydrodesulfurization, aromatics saturation and ring opening reactions with time on oil. Table 8 shows no loss in catalyst performance when operated on the second, higher sulfur feed.

EXAMPLE 27

The catalyst system of Example 23 was used to process the feed of Example 24. Product gravity was measured to follow catalyst stability for the integrated hydrodesulfurization and aromatics saturation reactions with time on oil. Table 8 shows inferior performance of this catalyst system on the 60 wppm sulfur feed. This is due to the inability of the system to protect the ring opening activity of the Ir catalyst as well as reduced aromatics saturation activity of both the Pt and Ir

TABLE 8

Processing Of Light Cat Cycle Oil Containing 60 wppm Sulfur and 56 Wt. % Aromatics 315° C., 650 psig, 5000 SCF/B $H_2$, 0.75 LHSV (over Pt catalyst)

| | | API Gravity @ Hr On Oil | | Wt. % Aromatics @ Hr On Oil |
|---|---|---|---|---|
| Example | Catalyst | 48 | 92 | 92 |
| 24 | Pt + ZnO | 32.8 | 32.8 | 3.4 |
| 25 | Pt + ZnO/Ir | 34.0 | 33.8 | 1.8 |
| 26 | Pt + ZnO/Ir + Pt on acid | 36.1 | 35.6 | 0.4 |
| 27 | Pt/Ir | 32.6 | 32.2 | 8.1 |

EXAMPLE 28

The procedure of Example 6 was followed to prepare a mixed/stacked catalyst bed comprising 0.05 wt. % Ru on alumina commingled with zinc oxide upstream of the Ir ring opening catalyst. This system was evaluated for the ring opening of methylcyclohexane containing 5 wppm sulfur as thiophene and 10 wppm sulfur as 4,6-diethyldibenzothiophene. The results in Table 9 demonstrate that the guard bed comprised of Ru admixed with zinc oxide was totally ineffective for the hydrosulfurization of the refractory sulfur type and that rapid and complete poisioning of the Ir catalyst resulted. Comparison with results from Example 7 hereof employing a 0.05 wt. % Pt catalyst demonstrate that all Group VIII noble metals are not equivalent for the process of this invention.

TABLE 9

Ring Opening Of Methylcyclohexane Containing 5 wppm Sulfur As Thiophene And 10 wppm Sulfur As 4,6-Diethyldibenzothiophene 275° C., 400 psig, 7.7 W/H/W, $H_2$/Oil = 6

| | | Conversion, Wt. % @ Hr On Oil | | | Ring Opening Rate @ Hr On Oil | | |
|---|---|---|---|---|---|---|---|
| Example | Catalyst | 5 | 10 | 20 | 5 | 10 | 20 |
| 28 | Ru + ZnO/Ir | 12.9 | 7.6 | 0.6 | 9.0 | 5.4 | 0.5 |
| 7 | Pt + ZnO/Ir | — | 24.2 | 20.9 | — | 18.6 | 16.8 |

What is claimed is:

1. A process for the desulfurization of a stream selected from petroleum and chemical streams containing condensed ring sulfur heterocyclic compounds in a process unit at conditions favoring aromatic saturation comprised of at least one reaction zone having a non-reaction zone upstream and downstream thereof and at least one sorbent zone containing a bed of hydrogen sulfide sorbent material downstream of the first of said at least one reaction zones, wherein the hydrodesulfurization catalyst and the hydrogen sulfide sorbent in the hydrogen sulfide sorbent zone are comprised as composite particles, which reaction zone(s) contain hydrodesulfurization catalyst, which process comprises:

(a) feeding said stream to one or more hydrodesulfurization reaction zones counter-current to upflowing hydrogen-containing treat gas;

(b) passing the resulting liquid phase effluent from at least one of said reaction zones through a zone containing a bed of a hydrogen sulfide sorbent material;

(c) recovering a vapor phase effluent from said reaction zone in an upstream non-reaction zone, which vapor phase effluent is comprised of hydrogen-containing treat gas and vaporized sulfur reaction products from said reaction zone; and (d) recovering downstream from said sorbent zone a liquid phase effluent characterized as having substantially no sulfur.

2. The process of claim 1 wherein the hydrodesulfurization catalyst contains at least one Group VIII metal on an inorganic refractory support.

3. The process of claim 2 wherein the Group VIII metal is a noble metal.

4. The process of claim 3 wherein the noble metal is selected from the group consisting of Pt, Pd, Ir, and combinations thereof.

5. The process of claim 4 wherein the hydrodesulfurization catalyst is promoted with one or more metals selected from the group consisting of Re, Cu, Ag, Au,Sn, and Zn.

6. The process of claim 4 wherein the concentration of noble metal is from about 0.05 to 3 wt. %, base on the total weight of the catalyst.

7. The process of claim 2 wherein the Group VII metal is Ni.

8. The process of claim 7 wherein the concentration of Ni is from about 1 to 70 wt. % based on the total weight of the catalyst.

9. The process of claim 8 wherein the concentration of Ni is from about 5 to 60 wt. % based on the total weight of the catalyst.

10. The process of claim 2 wherein the inorganic refractory support of the hydrodesulfurization catalyst is selected from the group consisting of oxides of Al, Si, Mg, B, Ti, Zr, P, and mixtures and cogels thereof.

11. The process of claim 2 wherein the inorganic refractory support of the hydrodesulfurization catalyst is selected from clays and zeolitic materials and mixtures thereof.

12. The process of claim 1 wherein the hydrogen sulfide sorbent material is selected from supported and unsupported metal oxides, spinels, zeolitic materials, and layered double hydroxides.

13. The process of claim 12 wherein the hydrogen sulfide sorbent is a metal oxide of metals from Groups IA, IIA, IB, IIB, IIIA, IVA, VB, VIB, VIIB, and VIII of the Periodic Table of the Elements.

14. The process of claim 13 wherein the metal is selected from the group consisting of K, Ba, Ca, Zn, Co, Ni, and Cu.

15. The process of claim 1 wherein the hydrogen sulfide sorbent zone is operated such that feed is flowing countercurrent to upflowing hydrogen-containing treat gas.

16. The process of claim 1 wherein the hydrogen sulfide sorbent zone contains at least one hydrodesulfurization catalyst and a hydrogen sulfide sorbent.

17. The process of claim 16 wherein the hydrodesulfurization catalyst and the hydrogen sulfide sorbent in the hydrogen sulfide sorbent zone are present in a mixed bed.

18. The process of claim 16 wherein the hydrodesulfurization catalyst and the hydrogen sulfide sorbent are characterized as being on the same inorganic refractory support particles.

19. The process of claim 1 wherein a hydrodesulfurization catalyst zone is downstream, with respect to flowing feed, to the last hydrogen sulfide sorbent zone.

* * * * *